US005351893A

United States Patent [19]

Young

[11] Patent Number: 5,351,893

[45] Date of Patent: Oct. 4, 1994

[54] ELECTROMAGNETIC FUEL INJECTOR LINEAR MOTOR AND PUMP

[76] Inventor: Niels O. Young, 714 W. State St., Boise, Id. 83702

[21] Appl. No.: 67,670

[22] Filed: May 26, 1993

[51] Int. Cl.[5] ..... B05B 1/30

[52] U.S. Cl. ..... 239/585.1; 251/129.21; 239/570

[58] Field of Search ..... 239/88, 89, 585.1, 570, 239/569; 417/410, 415; 251/129.21

[56] References Cited

U.S. PATENT DOCUMENTS

| | | | |
|---|---|---|---|
| 3,353,040 | 11/1967 | Abbott | 310/27 |
| 3,894,817 | 7/1975 | Majoros et al. | 417/415 |
| 4,004,258 | 1/1977 | Arnold | 335/17 |
| 4,046,112 | 9/1977 | Deckard | 123/32 JV |
| 4,090,097 | 5/1978 | Seilly | 310/27 |
| 4,123,691 | 10/1978 | Seilly | 318/119 |
| 4,129,253 | 12/1978 | Bader et al. | 239/88 |
| 4,129,254 | 12/1978 | Bader et al. | 239/96 |
| 4,129,255 | 12/1978 | Bader, Jr. et al. | 239/96 |
| 4,129,256 | 12/1978 | Bader, Jr. et al. | 239/96 |
| 4,278,904 | 7/1981 | Seilly | 310/27 |
| 4,545,209 | 10/1985 | Young | 62/6 |
| 4,572,433 | 2/1986 | Deckard | 239/88 |
| 4,578,956 | 2/1986 | Young | 62/6 |
| 4,744,543 | 5/1988 | Renheim | 251/129.21 |
| 4,784,322 | 11/1988 | Daly | 239/89 |
| 4,804,314 | 2/1989 | Cusack | 417/322 |
| 4,844,339 | 7/1989 | Sayer et al. | 239/5 |
| 5,011,082 | 4/1991 | Ausiello et al. | 239/585 |

FOREIGN PATENT DOCUMENTS

| | | | |
|---|---|---|---|
| 0324905 | 7/1989 | European Pat. Off. | 239/88 |
| 0213472 | 9/1984 | Fed. Rep. of Germany | 239/88 |
| 0687854 | 3/1965 | Italy | 239/88 |

*Primary Examiner*—Andres Kashnikow

*Assistant Examiner*—Christopher G. Trainor

*Attorney, Agent, or Firm*—Frank J. Dykas; Craig M. Korfanta

[57] ABSTRACT

The invention is a linear electromagnetic motor which operates to reciprocate a pump plunger within a central pump barrel. The motor has a ferromagnetic armature annularly connected to the pump plunger, located in an annular space in the motor core about the pump plunger. The armature is itself annularly surrounded by a permanent polarizing ring magnet located between two motor drive coils. The motor operates by switching the polarizing magnetic flux of the ring magnet by a control magnetic flux created by electric current in the motor drive coils. On its backward end, the pump plunger is biased by a spring in the direction of its forward stroke. However, when the armature is latched by the magnet at its backward stroke location (distance A=0), the strength of the magnet overcomes the bias in this spring. As soon as the control magnetic flux changes, the magnetic latch at the backward stroke location is released, and the spring bias plus the magnetic attraction in the forward stroke direction act to quickly accelerate the armature and the pump plunger in the forward stroke direction at high speed and force. Before the end of its forward stroke, the pump plunger contacts a check slug whose location is mechanically adjusted to create a desired volume of fuel to be delivered. The contact of the check slug with the plunger suddenly seals off a volume of fuel existing within the voids of a spray valve. The pump plunger can be said to have crashed into the fuel, whose pressure builds rapidly as a result. When the fuel pressure reaches the set pressure of a relief valve it escapes as a spray into an engine headspace until the plunger reaches its mechanical end-stop.

11 Claims, 8 Drawing Sheets

ELECTROMAGNETIC FUEL INJECTOR LINEAR MOTOR AND PUMP

BACKGROUND OF THE INVENTION

1. Technical Field

This invention relates generally to internal combustion engines. More specifically, it relates to fuel injectors for such engines. I have invented an electromagnetic fuel injector drive motor and pump of minimum size and minimum electric power requirements. The motor and pump meters a volume of liquid fuel at high pressure for spraying into the headspace of compression ignition or spark ignition internal combustion engines.

2. Background Art

For two-stroke spark ignition (SI) engines, for example, injection of fuel directly into the headspace above the piston in a cylinder has important advantages. If injection is timed late enough, no fuel is blown out the exhaust during scavenge. This raises the thermal efficiency and reduces the unwanted emissions that have for so long blemished the performance of carbureted two-stroke engines.

Head-injected two-stroke compression-ignition (CI, or Diesel) engines have existed since before 1930. But an SI engine borrowing the injector technology of any existing Diesel will not usually have as high a power output per unit weight as the same SI engine using a carburetor. Carbureted SI engines tend to have higher outputs per unit weight than CI engines because they can run at higher speeds. This is because fuel injection into an engine headspace must achieve a useful fuel/air mixture within limits of time and turbulence that become more constraining as the engine speed increases. On the other hand, there is no limit to the speed of a carbureted engine because whatever time and turbulence is needed to create a uniform fuel/air mixture can be provided by a carburetor and intake system.

An object of this invention is to provide a head-injection system for SI two-stroke engines which will enable higher engine speeds so that the power output per unit weight can approach that which would have been possible had a carburetor been used.

A head injector must act to atomize, vaporize, and mix fuel with as much as possible of the air within the head-space. Existing head-injection systems for SI two-stroke engines have disadvantages.

Some of them have mechanically operated fuel pumps. The blow-by of such pumps results in reduced and uncontrolled fuel delivery at low speeds such as idle, and the rate of mass-flow through the nozzles varies with engine speed. Therefore most recent work in the field of fuel injection for SI engines uses electrical injector pumps or electrical flow valves. This invention concerns a novel electromagnetic fuel pump that has special capabilities. The linear motor and pump of this invention provides a mass flow through the spray nozzle which is substantially independent of engine speed and delivery volume. The spray characteristics of the spray valve can therefore be more precisely tailored than others.

Some existing head-injection systems use compressed air at typically 5 atmospheres to help atomize fuel valved into the injector at 2 atmospheres. The fine spray so produced could have been achieved without the need for compressed air by pumping fuel into an appropriate nozzle at 50 or more atmospheres pressure. The linear motor fuel pump of this invention is capable of injection pressures up to 200 atmospheres so enabling usefully fine sprays without the expense of providing an air compressor.

Objects of this invention which generally advance the state of the art beyond its present boundaries include:

An electromagnetic fuel motor and pump of minimum size for a given efficiency of converting electrical power input to flow power output. Because of the limited engine compartment volume needed for spark plugs and cooling, this is important.

An electromagnetic fuel motor and pump where the volume of high pressure fuel existing in the voids of plumbing, flow valves, spray formers etc., is a minimum. This reduces the hazards of high pressure fuel, avoids pressure and flow pulsations which often plague the development of high-pressure injectors, and avoids significant energy storage due to fuel compressibility which could complicate matching the linear motor output force to the force required by the pump.

U.S. Pat. No. 3,353,040 (Abbott) discloses an electromagnetic motor for converting electric power to reciprocating mechanical power. The motor in this patent is used to ensonify the ocean with audible or super-audible sound waves.

U.S. Pat. No. 4,004,258 (Arnold) discloses a position-indicating solenoid with a ferromagnetic plunger movable between two stops, and fixed permanent magnets which cause the plunger to adhere to the stop to which it is moved. Movement of the plunger is accomplished by a winding about each stop which when excited by an electrical pulse exerts an attractive force on the plunger.

U.S. Pat. Nos. 4,046,112 and 4,572,433 (Deckard) disclose an electromagnetic fuel injector with a solenoid actuated valve for controlling the flow of fuel through bleed orifice and charge orifice passages.

U.S. Pat. Nos. 4,090,097, 4,123,691 and 4,278,904 (Seilly) disclose an electromagnetic motor with an annular member and a core member interengageable by screw threads.

The technical paper, Low Pressure Electronic Fuel Injection System for Two-Stroke Engines by Edmond Vieilledent, published by the Society of Automotive Engineers, Inc., Technical Paper Series 780767 (1978), describes different fuel injection systems which the Motobecane Company tested for several years, and discloses a direct electronic injection system, using electromagnetic injectors, specially adapted to the two-stroke engine.

U.S. Pat. Nos. 4,129,253, 4,129,254, 4,129,255 and 4,129,256 (Bader et al.) disclose electromagnetic fuel injectors of the same general construction as U.S. Pat. Nos. 4,046,112 and 4,572,433 (Deckard), discussed above.

U.S. Pat. Nos. 4,545,209 and 4,578,956 (Young) disclose a linear driver motor for a cryogenic split Sterling refrigerator. The motor includes a permanent magnet mounted to the moving armature of the motor which in turn drives a piston element.

U.S. Pat. No. 4,804,314 (Cusack) discloses a fluid injection pump with an outer cylinder made of a negative magnetostrictive material, and an inner piston made of a positive magnetostrictive material. When a magnetic field is applied to the assembly, the cylinder contracts and the piston expands to expel fluid past a head valve through an injection port.

U.S. Pat. No. 4,844,339 (Sayer et al.) discloses a fuel injector with an electromagnetic fuel metering valve.

U.S. Pat. No. 5,011,082 (Ausiello et al.) also discloses a fuel injector with an electromagnetic fuel metering valve.

DISCLOSURE OF INVENTION

The invention is a linear electromagnetic motor which operates to reciprocate a pump plunger within a central pump barrel. The motor has a ferromagnetic armature annularly connected to the pump plunger, located in an annular space in the motor core about the pump plunger, which annular space is greater in axial length than the armature by a distance A+B which equals the pump plunger stroke length.

The armature is itself annularly surrounded by a permanent polarizing ring magnet located between two motor drive coils. The motor operates by switching the polarizing magnetic flux of the ring magnet by a control magnetic flux created by electric current in the motor drive coils. This way, the armature is bi-stable under the magnetic forces, even when the coil currents are zero, due to the permanent polarizing magnet—the magnet latches the armature to the limit of either the backward or forward stroke of the pump plunger.

On its backward end, the pump plunger is biased by a spring in the direction of its forward stroke. However, when the armature is latched by the magnet at its backward stroke location (distance A=0), the strength of the magnet overcomes the bias in this spring. As soon as the control magnetic flux changes, the magnetic latch at the backward stroke location is released, and the spring bias plus the magnetic attraction in the forward stroke direction accelerate the armature and the pump plunger in the forward stroke direction at high speed and force.

Before the end of its forward stroke, the pump plunger crashes against a pump check slug which is biased in the backward stroke direction by a spring. The crash impact between the pump plunger and the check slug causes the spring biasing the slug to compress, whereby liquid fuel ahead of the check slug that is sealed off by contact between the pump plunger and the check slug and existing within the voids of a spray valve is pressurized and thrust ahead to form a spray as a result of the forward stroke of the pump plunger which is in turn caused by switching of the standing polarizing magnetic flux in a linear electromagnetic motor.

A BEST MODE FOR CARRYING OUT THE INVENTION

Figure 1:
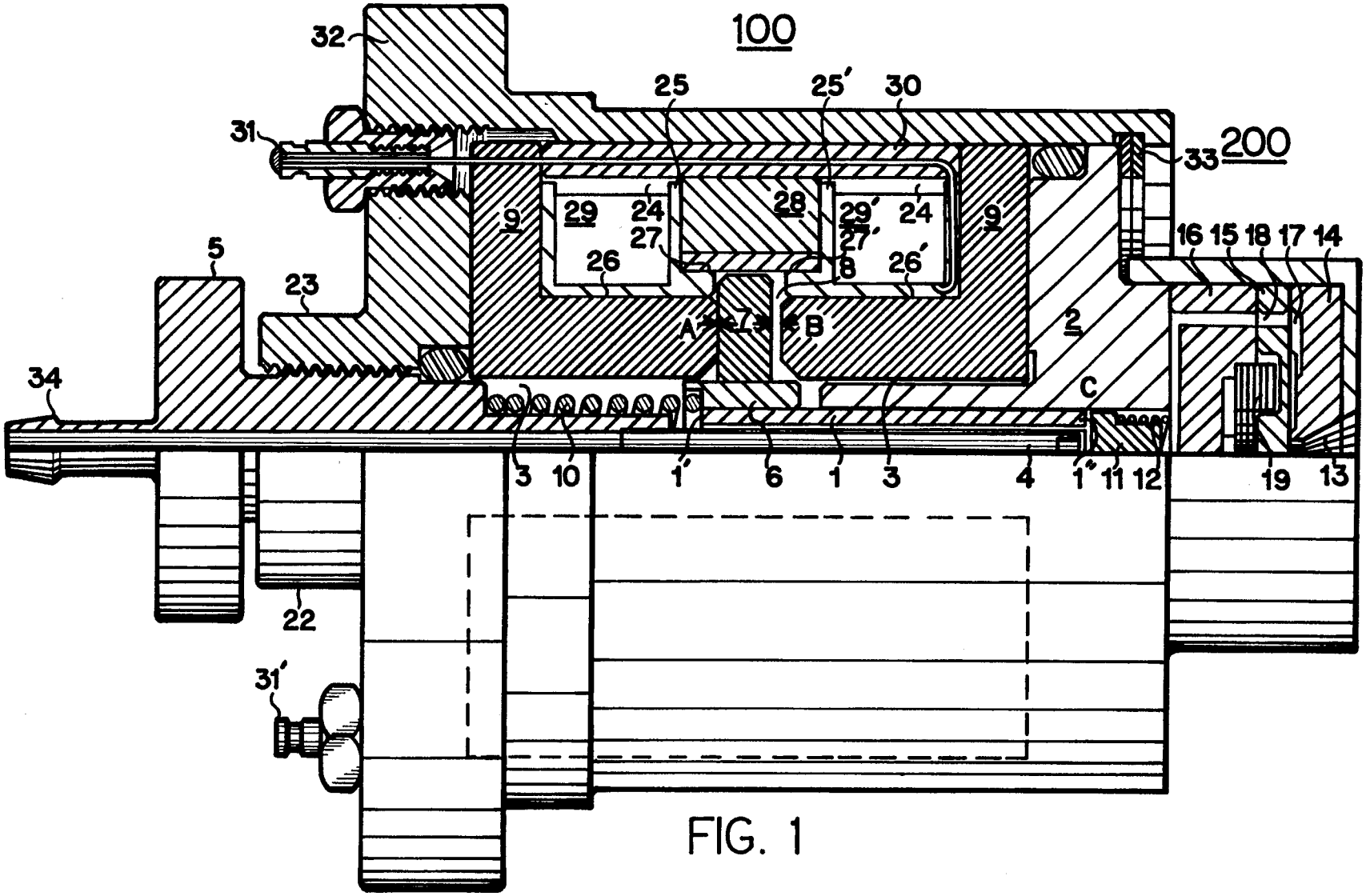
FIG. 1 is a side view, partially in cross-section, of the fuel injector linear motor and pump according to the invention, with a spray valve attached.
Figure 2A:
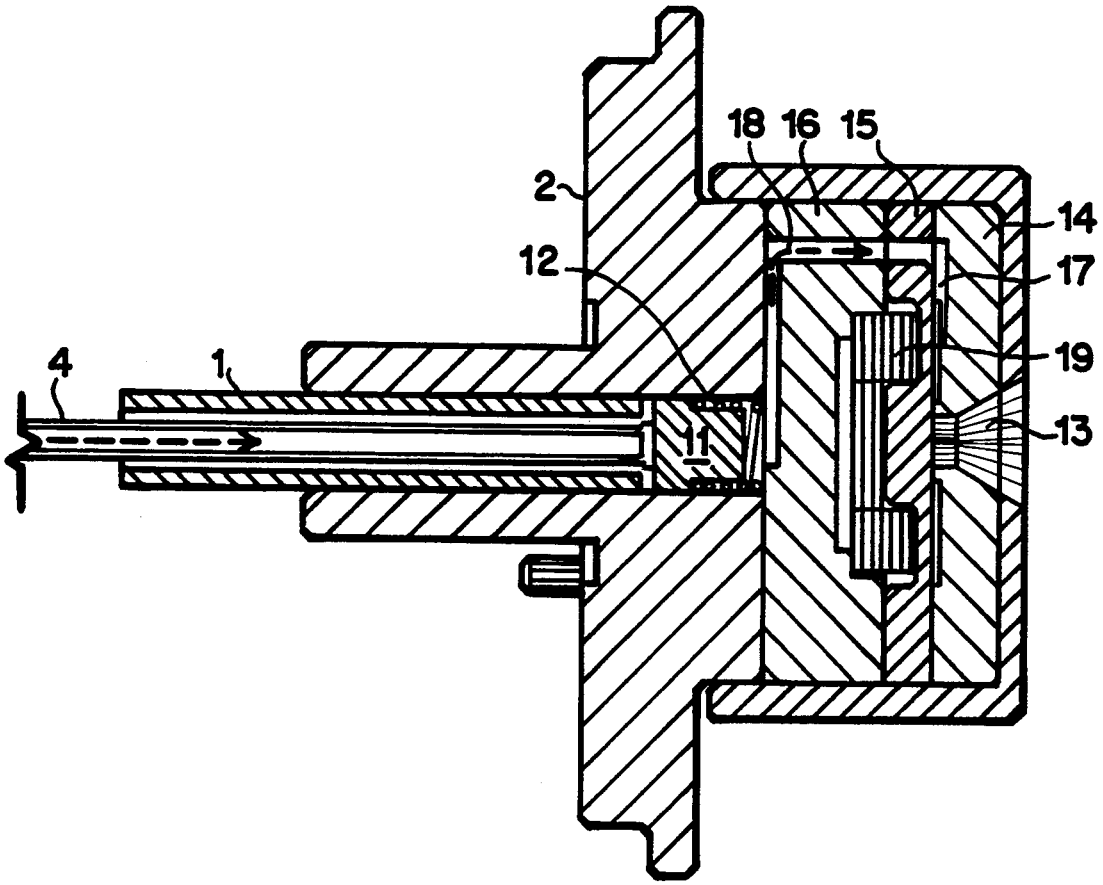
FIGS. 2A, 2B and 2C are detail, partial, longitudinal sectional views near the forward end of the pump illustrating the sequence of operation of the spray valve and pump.
Figure 2B:
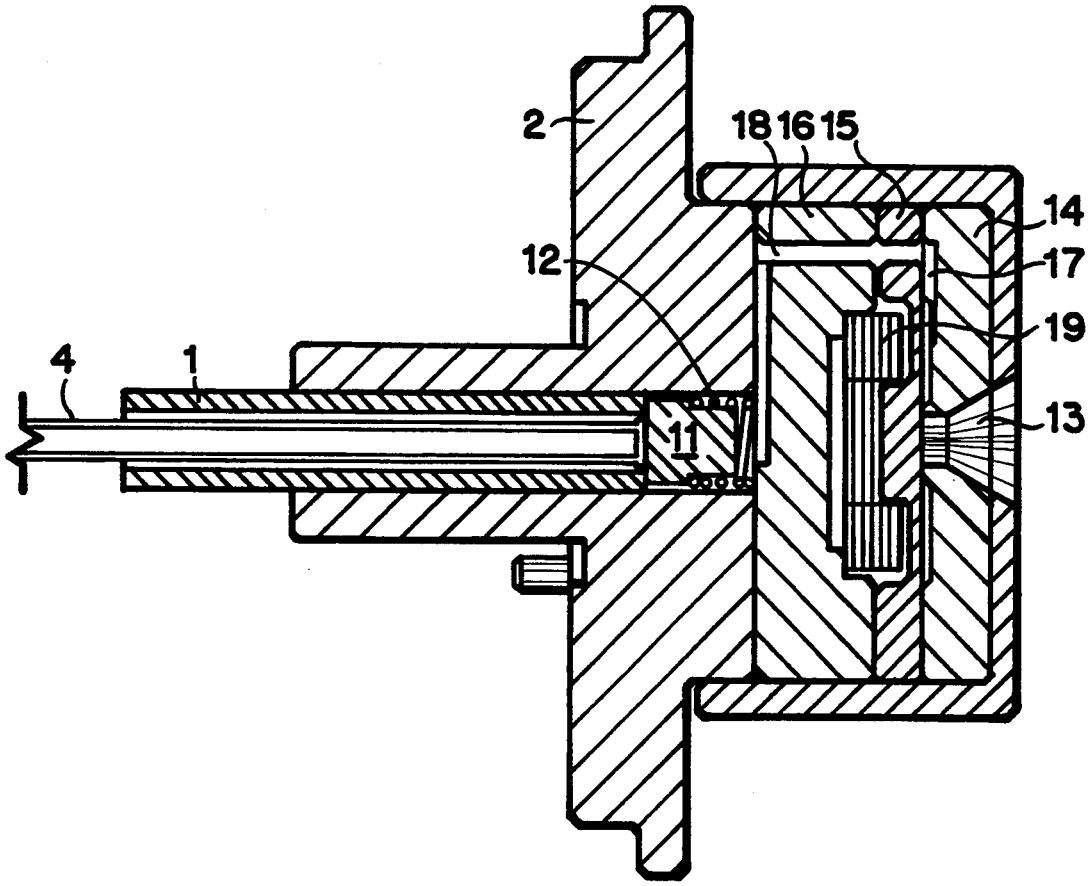
Figure 2C:
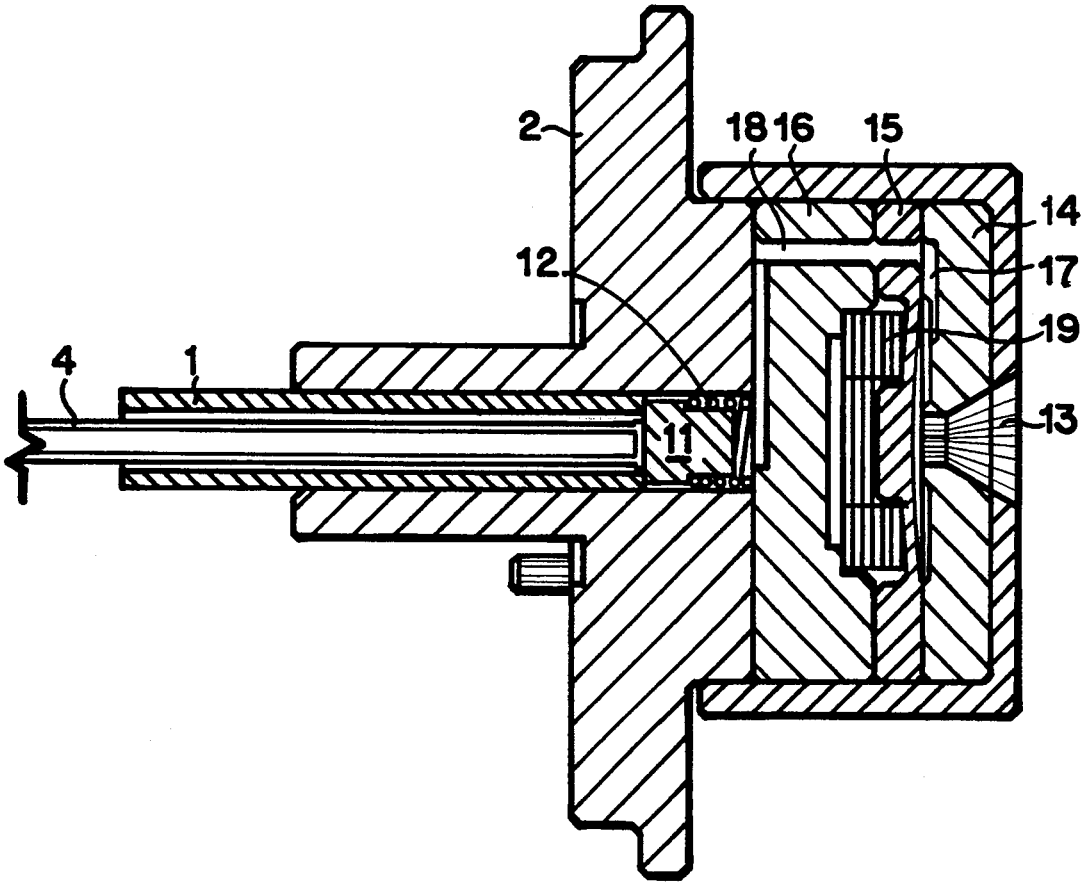

This invention meters a fuel volume at high pressure for spraying into the headspace of compression ignition or spark ignition internal combustion engines. A linear electromagnetic motor operates to reciprocate a pump plunger within a pump barrel. The motor has a ferromagnetic armature annularly connected to the pump plunger, preferably via a non-magnetic interface ring. The armature is located in an annular space in the motor core about the pump plunger. The annular space is greater in axial length than the armature by a distance A+B equal to the pump plunger stroke length.

The armature is itself annularly surrounded by a permanent polarizing ring magnet located between two parallel motor drive coils. The motor operates by switching a radial polarizing magnetic flux of the ring magnet with a control magnetic flux created by electric current in the motor drive coils. The armature is bi-stable under the magnetic forces when the coil currents are zero, due to the permanent polarizing magnet—the magnet latches the armature to the limit of either the backward or forward stroke. In other words, when the coil current is zero either A=0 or B=0 while the sum, A+B, is a constant equal to the pump plunger stroke length.

On its backward end, the pump plunger is biased by a spring in the direction of its forward stroke. However, when the armature is latched by the magnet at its backward stroke location (distance A=0), the strength of the magnet overcomes the bias force of this spring. When the armature is latched at its backward stroke location the pump is loaded with fuel and there is no electrical current in the drive coils. The linear motor and pump is in a state of readiness. To begin fuel injection, current flows in the drive coils which creates a control magnetic flux that opposes the polarizing flux existing between the armature 7 and the polepiece 9. The polarizing flux is thereby switched to a new path existing between the armature 7 and the polepiece 9'. In this way, the magnetic latch at the backward stroke location is released, and the spring bias plus the magnetic attraction in the forward stroke direction begin to accelerate the armature and the pump plunger in the forward stroke direction. Subsequent events to be described later enable the linear motor and pump of this invention to meter fuel into a spray valve at high pressure and for short time periods.

After having moved about half of its forward stroke, the forward end of the pump plunger contacts a pump check slug which is biased in the backward stroke direction by a spring. The check slug spring exerts much less force than the plunger spring. The contact between the pump plunger and the check slug causes the spring biasing the slug to begin compressing. At this moment when the pump plunger contacts the check slug, the volume of fuel beyond the forward end of the check slug is sealed off and isolated within the voids of a spray valve. As the pump plunger continues advancing toward the forward end, it forces the check slug toward the forward end because of the contact. As the check slug continues moving to the forward end the isolated volume of fuel is compressed. Continued movement of the check slug toward the forward end causes continued compression of the isolated volume of fuel.

As a result of the continued compression, pressure within the isolated fuel volume builds until it is enough to open the spray valve. The spray valve is designed to act as a pressure relief valve. When this valve opens, a spray is formed. Relief pressures are typically within the range of 750 to 3000 psi, or 50 to 200 atmospheres.- The spray valve also functions as a non-return or check valve.

The most important feature of this sequence of events is that the plump plunger "crashes" into the hydraulic load created by the isolated volume of fuel being compressed within the voids of the spray valve. The crash begins at the time and place where the pump plunger first contacts and makes a hydraulic seal against the check slug. From this moment, pressure builds up within the voids of the spray valve. This pressure builds up from the continued forward movement of the plunger until it reaches the set pressure of the pressure relief valve. From this moment onward, the pressure remains substantially constant as regulated by the pressure relief valve, because fuel escapes by flowing through the pressure relief valve at the same time it forms a spray. The spray continues until the linear motor reaches the mechanical limit at the end of its stroke.

The crash feature is important because it enables a fuel spray to take place for a time duration which is shorter than the time required for the linear motor to move its full stroke. It is also important as a way to match the output force of the linear motor to the force required for pumping fuel through a spray valve. Also, the crash feature is a way to capture nearly all of the output mechanical energy produced by the linear motor and convert it into the energy of the pumped fuel. By capturing as much as possible of the mechanical output of the linear motor, its volume and weight is minimized. The value of the crash feature may be better understood by examining the details of the linear motor.

The energy available from a linear motor is a fixed quantity per cycle. This fixed cycle energy is established for most electromagnetic linear motors by the overall dimensions, the saturation magnetization of iron, and the energy dissipation, among many design parameters. The linear motor of this invention is designed to maximize the output of mechanical energy per cycle, while at the same time to minimize size and weight. But the distribution of its output force in time and as a function of armature position does not match the requirements of a plunger pump except for the features of this invention.

Electrical input energy is converted into mechanical output energy by the linear motor. The linear motor of this invention is bi-directional because it produces an output force during both the forward and backward strokes. The linear motor of this invention is also polarized by a permanent magnet so that only about one-half of the magnetic flux that creates axial force is produced by the coils. As a result, the bi-directional and polarized linear motor of this invention has less volume and weight than other electromagnetic designs which would also convert equal electrical input energy into equal mechanical output energy per cycle.

But a bi-directional polarized linear motor does not of itself create the forces required by a plunger pump to spray fuel into the headspace of an internal combustion engine. This invention teaches how the optimum linear motor may be matched to the special hydraulic load created by a plunger pump that is used for fuel injection.

First, the spring biasing the pump plunger stores nearly all of the energy of the backward stroke of the plunger and delivers it during the forward stroke for pumping fuel. Second, the energy of the forward stroke is stored as kinetic energy until the plunger crashes into the check slug. Third, energy after the crash consists of the sum of kinetic energy, electromagnetic energy from the linear motor during the remainder of its forward stroke, and stored energy from the spring biasing the plunger. All of this energy, excepting friction and other losses, is converted into a pressure and flow of fuel.

The force required to pump fuel through the spray valve is a constant, proportional to the delivery pressure P, and is independent of plunger position. The crash feature and the energy storage spring correct this mismatch. There are three distinct forces which add together in order to pump fuel: spring force, magnetic force, and inertia force. At first contact of the plunger with the check slug, the available magnetic force is low but the inertia force and the spring forces are high. Toward the end of the pumping stroke, the magnetic force is high while the inertia and spring forces are low. Therefore, the crash feature with the magnetic and the spring forces together enables a roughly constant pumping force as desired.

The spring assist feature makes it possible to collect and use a major fraction of the energy of the reverse or reload stroke of the plunger. To store this spring energy until it is needed and without an electrical input to the linear motor requires that the moving assembly, including the plunger, latch magnetically at the end of its backward stroke. The magnetic latch effect is a result of the polarizing magnet. This design of linear motor has an output force which varies strongly with position. The working stroke starts with just enough force to unlatch, and the output force increases as the moving parts approach the end of stroke. The spring force depends upon position in roughly the same way that the linear motor force during the reverse stroke depends upon position. This behavior maximizes the fraction of motor energy available during the reverse stroke that is stored by the spring.

The energy of pumped fuel $W_F$ is equal to the pressure $P_{spray}$ of this pumped fuel multiplied by the volume V that is delivered:

$$W_F = P_{spray} V \quad (1)$$

This invention shows a linear motor of optimum design (bi-directional and polarized) which we now assume to have a fixed energy output $W_M$ per cycle which is equal to its average output force multiplied by the total distance traveled per cycle:

$$W_M = (2F_{average})(A+B), \text{ assumed constant.} \quad (2)$$

The energy $W_M$ available from the linear motor must exceed the energy $W_F$ that is absorbed by pumping the fuel:

$$W_M \geqq W_F \quad (3)$$

The volume V of fuel that is delivered is adjustable in order to best meet the requirements of the internal combustion engine and its running conditions which are used with the linear motor and pump of this invention. By combining eqs. (1), (2), and (3) we can therefore write an equation which shows that the delivery volume V must be between the limits of zero and a limit volume called $V_L$:

$$0 \leqq V \leqq (2F_{average})(A+B)/P_S, \text{ or, } 0 \leqq V \leqq V_L. \quad (4)$$

To explain the meaning of this limit volume, consider the volume V displaced by the pump plunger. If the plunger of area S pumps for its entire forward stroke length of A+B, then it will pump a volume $V_{A+B}=S(A+B)$. There is no crash feature unless $$V_L < V_{(A+B)} \quad (5)$$

In general, for a crash of useful proportions to occur, we recommend that $V_L < (\frac{1}{2})V_{A+B}$.

The crash time is of shorter duration that the full forward stroke of the linear motor. This invention allows the crash to occur for any reasonable time interval during which fuel is delivered. The fuel delivery time can have any duration that is shorter than the time required for a forward stroke of the linear motor. This important option is provided by the spring and crash features of this invention. Linear motors are generally too slow and would pump over too long a time interval without these new features.

The spring and crash features are applicable to designs of linear motor not specifically called out in this description.

Preferably, the pump plunger is a hollow cylinder annularly surrounding a tubular sting for delivering circulating liquid fuel in the vicinity of the check slug. This way, the assembly is cooled in this region by the circulating fuel.

The axial location of the sting determines the fuel volume that is delivered. When the pump plunger is at its loaded, ready position, the check slug rests snug against the sting under the delicate spring force of the check spring. Therefore the initial position of the check slug is determined by the axial location of the sting. The check slug is held off from contact with the pump plunger and no fuel is pumped until the plunger advances enough on its pumping stroke, moving toward the forward end, to contact the check slug. Pumping begins when contact is made.

The volume that is pumped depends upon the axial location of the check slug at the moment of first contact. Therefore the axial location of the sting determines the pumped volume per shot.

Equation (4) shows that if the pump delivery volume V is adjusted to too large a volume, there may be no spray. In other words, the pump plunger will crash against a hydraulic load that is too great to allow the plunger to complete its stroke, and at best an indefinite volume of fuel no greater than $V_L$ will be delivered. The overall design of linear motor, pump, and spray valve should be such that the limit volume $V_L$ is reached at about one-half of the full stroke A+B of the plunger.

The axial location of the tubular sting is adjustable so that the volume V of fuel delivered per shot can be adjusted. The force of the check slug upon the sting is very small compared to the plunger forces, and is mainly the result of the delicate check spring. Therefore the axial adjustment of the sting does not involve any large forces and it can be adjusted (and locked if desired) with high precision and stability.

Referring to the Figures, there is depicted generally a fuel injector motor and pump 100 attached to a spray valve assembly 200 for an internal combustion engine. The fuel injector motor and pump 100 has elongated pump plunger 1, preferably made of spring hard steel. Pump plunger 1 reciprocates within pump barrel 2, preferably made of maximum hard steel, and within central cylindrical space 3. The backward stroke end 1' of pump plunger 1 is towards the left-hand side of the Figs., and the forward stroke end 1'' is towards the right-hand side in the Figs.

Preferably, pump plunger 1 is a hollow cylinder annularly surrounding fuel delivery sting 4, both of which are located within the cylindrical space 3. Sting 4 is preferably made of AISI 301 hard-drawn hypodermic steel tubing connected at its backward end to pump delivery adjuster 5.

Pump plunger 1 is preferably annularly surrounded by and attached to non-magnetic interface ring 6. In turn, interface ring 6 is annularly surrounded by and attached to ferromagnetic armature 7 of a certain width. Armature 7 is located in a central annular space 8 between motor cores 9 and 9'. The annular space 8 is defined axially by radial surfaces of the motor cores 9 and 9' which create gap distances A and B between corresponding radial surfaces on armature 7. The annular space 8 is greater in axial length than the armature 7 by a distance A+B which equals stroke length of the pump plunger 1.

On its backward end, pump plunger 1 is biased by pump bias spring 10 in the plunger's forward stroke direction. Pump bias spring 10 is preferably made of AISI 301 hard-drawn steel.

Near the end of its forward stroke, pump plunger 1 contacts the pump check slug 11 which is biased in the backward stroke direction by pump check spring 12. Preferably, pump check slug 11 is made of material having a low volume compressibility and a low density such as aluminum or polyimide plastic, and check slug spring 12 is made of AISI 301 hard-drawn steel. When the pump plunger 1 contacts the check slug 11 a volume of fuel is sealed off and isolated within the voids of the spray valve 200. The spray valve is a special form of pressure relief valve which in the act of relieving pressure forms a spray suitable for combustion in the headspace of an internal combustion engine, whereby liquid fuel ahead of the check slug 11 that is sealed off by contact with the pump plunger 1, and existing within the voids of a spray valve, is pressurized and thrust ahead to form a spray by means of spray orifice 13.

After the pump plunger contacts the check slug it continues to move to the forward end under the sum of three forces: the spring force, the magnetic force, and the inertia force. The volume of fuel which is sealed off within the voids of the spray valve begins to compress, and its pressure rises.

The pump plunger can be said to have crashed into the hydraulic load created by the isolated volume of fuel being compressed. The fuel pressure rises as a result of the crash, until it reaches a pressure which the spray valve can relieve by forming a spray. The pump plunger continues its stroke to the forward end, delivering fuel continuously into the voids of the spray valve and thence emerging as a spray of fuel. Finally the pump plunger reaches the end of its stroke where there is mechanical contact between armature 7 and the forward end of motor core 9' where B=0. This event marks the end of the plunger stroke and also the end of fuel delivery. The volume of fuel delivered depends upon how far the pump plunger moves between contact of the pump plunger 1 with the check slug 11, and end of stroke when B=0.

Pump bias spring 10 helps create high speed and force in the forward stroke of pump plunger 1. In the position shown in FIG. 1, the pump has loaded itself with fuel and is ready to shoot. Spring 10 biases against the magnetic polarization force, but is not quite strong enough to open gap A. Because of bias spring 10, the first small drop of polarizing flux density between armature 7 and motor core 9 at gap A will release the contact at A.

Figure 3A:
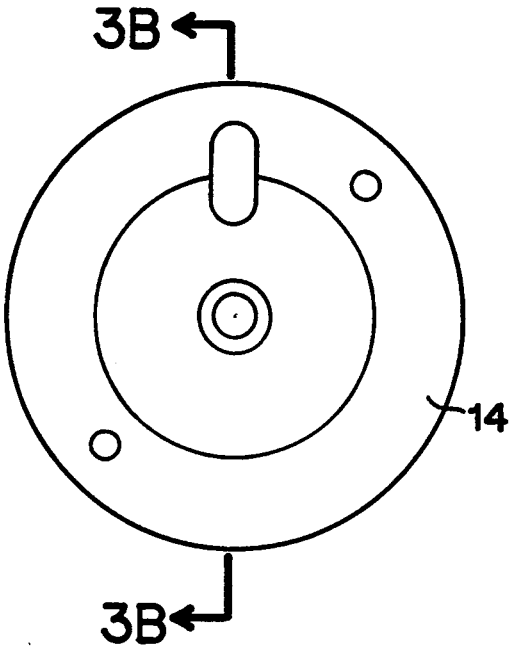
FIG. 3A is a rear view of the orifice plate utilized in the spray valve of FIG. 1.
Figure 3B:
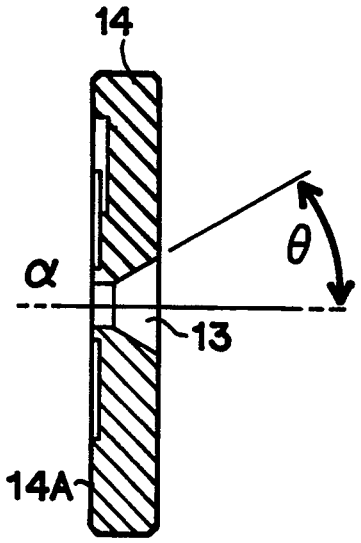
FIG. 3B is a cross sectional view of the orifice plate taken along line 3B—3B in FIG. 3A.
Figure 6:
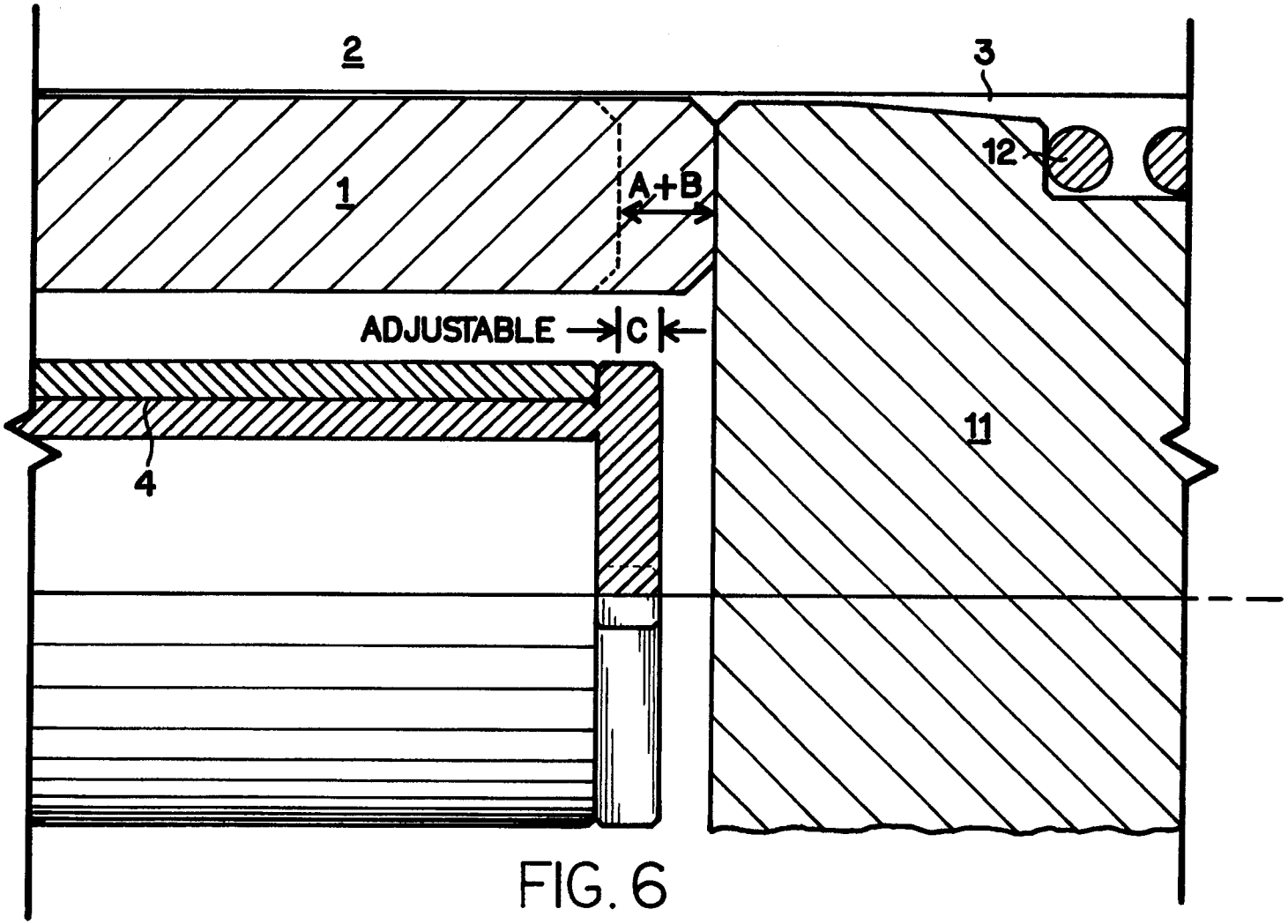
FIG. 6 is a detail, partial, longitudinal sectional view near the forward end of the tubular sting illustrating its relationships with the pump plunger and the check slug.

A hammer effect in pump plunger 1 helps shooting of fuel at high pressure for a short time. Only inertia force opposes acceleration of the moving assembly (plunger 1, interface ring 6, and armature 7) under the sum of spring and magnetic axial forces until gap C between plunger 1 and check slug 11 begins to close. At the moment when C=0 as shown in FIG. 6A, the check slug 11, urged by check slug spring 12, contacts the end of the plunger 1. Fuel pressure begins to build up in the spray valve 200 because it contains its own check or pressure relief assembly which comprises, for example, an orifice plate 14, a valve plate 15 and an interface plate 16. The orifice plate 14 is shown in detail in FIGS. 3A and 3B and acts to define a centrally located spray.

The rear surface 14A of orifice plate 14 is recessed such that, when it is mated with valve plate 15, as illustrated in FIG. 1, a fuel chamber 17 is formed. Fuel chamber 17 communicates with motor and pump 100 through passage 18 defined by valve plate 15 and interface plate 16.

Figure 4A:
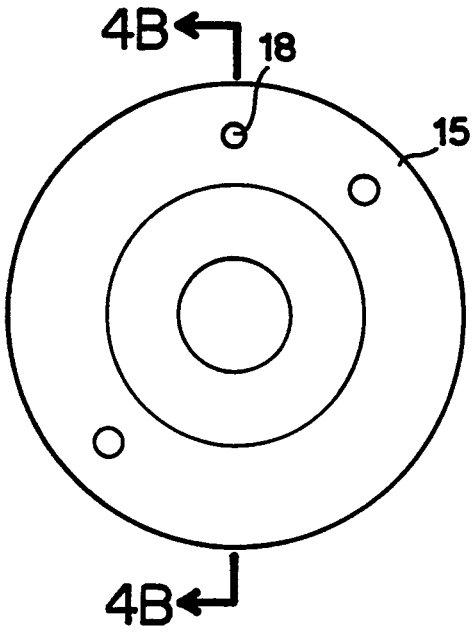
FIG. 4A is a rear view of the valve plate utilized in the spray valve shown in FIG. 1.
Figure 4B:
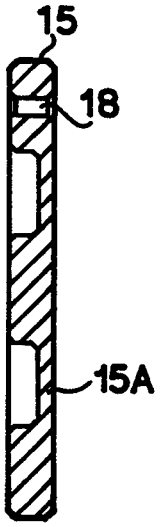
FIG. 4B is a cross sectional view of the valve plate taken along line 4B—4B in FIG. 4A.
Figure 5:
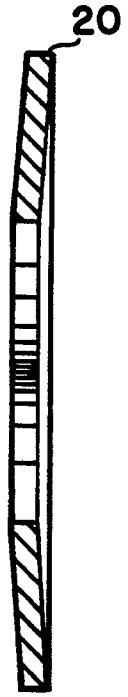
FIG. 5 is a cross sectional view of a coned disc spring utilized to bias the valve plate in the spray valve shown in FIG. 1.

Valve plate 15 is shown in detail in FIGS. 4A and 4B and has a generally circular configuration with a portion of its rear surface recessed to accommodate a stack of coned discs 19 interposed between it and interface plate 16. Valve plate 15 has a front surface **15*a* adapted to contact the annular and flat rear surface 14*a* of the orifice plate 14. Surface 14*a* surrounds the spray forming orifice 13 such that, when surfaces 14*a* and 15*a* are in contact, fuel is prevented from passing from the chamber 17 into the spray forming orifice 13. The stack of coned discs 19 exerts a sufficient force on the valve plate 15 to keep surface 15*a* in contact with surface 14*a* until a predetermined fuel pressure is built up within chamber 17. Once the fuel in chamber 17 has reached the predetermined injection pressure $P_I$, the surface 15*a* is displaced away from surface 14*a* to allow the pressurized fuel to pass from the chamber 17, through the spray forming orifice 13, into the combustion chamber. The stack of coned discs 19 comprises a plurality of individual coned discs 20 illustrated in FIG. 5**. The discs have a generally dished, annular shape such that a plane containing the inner periphery is axially displaced slightly from the plane containing the outer periphery.

The parallel-plate spray valve shown here is the subject of a patent application. The spray is the result of fuel flowing radially inward in a gap between valve plate 15 and orifice plate 14. The gap opens as the result of high fuel pressure within the space 17. For a spray and relief valve pressure of 10 MPa (1470 psi or 100 atmospheres) the gap opens typically to about 12 μmeters. Fuel flowing radially toward the center moves at a velocity of about 90 m $sec^{-1}$. The inflowing sheet traveling along the flat surface of the valve plate 15 loses velocity by viscous friction on its way toward the center. When it meets itself near the center it collects into a jet which shoots away from the flat surface of the valve plate at about 50 m $sec^{-1}$. This jet has a circular cross-section with a minimum diameter of at least 212 μmeters (0.0083 inch). The fuel jet diameter is only about 14% of the diameter of the hole which formed it. The jet soon breaks up by capillary instability and air drag, processes well-known as among the necessary events leading to atomization of the charge in a fuel injected internal combustion engine.

Spray valve 200 opens at some suitable injection pressure, and it also prevents backflow so that the injector pump can reload with fuel. During the crash, the moving assembly does work against the hydraulic load caused by the pressure relief valve in the spray assembly. The moving assembly "crashes" into this hydraulic load because the gap C is always greater than about half of the stroke (A+B) of the moving assembly. Note that $(A+B)>C>1/2(A+B)$.

The pump delivery volume D is equal to the stroke Q of the pump check slug 11 multiplied by the area S of the pump barrel 2: $D=SQ=S(A+B-C)$. The gap C therefore controls the delivery volume D. The gap C is adjusted by the pump delivery adjuster 5. This adjustment can be manual, pre-set, or under electronic control by means of a micro-motor, not shown, geared to the adjuster 5. Spring 10 removes backlash in this adjustment. Backlash could also be the result of looseness in the micrometer-like threads that control the axial location of the sting 4. A nut 22 is used as a squeeze clamp to remove looseness in the micrometer-like thread of the delivery adjuster 5. This technique is described in U.S. Pat. No. 4,848,953 to Young.

Motor cores 9 and 9' are preferably made of laminated, ferromagnetic iron. Laminations in the form of pie-shaped pieces are suitable. Cores 9 and 9' surround central cylindrical space 3 which surrounds pump barrel 2 and bias spring 10. Motor cores 9 and 9' are configured to create a central recessed volume 24 between them. Bobbins 25 and 25' are supported on the male cylindrical surfaces 26 and 26', respectively, of the motor cores 9 and 9', respectively in central recessed volume 24. The bobbins have projecting male cylindrical surfaces 27 and 27', respectively, which in turn support the ring magnet 28. The bobbins 25 and 25' also carry motor drive coils 29 and 29' respectively in central recessed volume 24. The magnetic flux return 30 consists of four clam-shell like sectors which rest upon the outer periphery of the ring magnet held in place by the attraction of the ring magnet. Bobbins 25 and 25' are wound with enameled copper magnet wire to form coils 29 and 29'.

Preferably, ring magnet 28 is made of $SmCo_5$, and the flux return 30 is ferromagnetic. Ring magnet 28 annularly surrounds armature 7. Likewise, drive coils 29 and 29' annularly surround the motor cores 9 and 9'. The motor operates by switching the polarizing magnetic flux of ring magnet 28 by a control magnetic flux created by electric current in the coils 29 and 29'. FIG. 1 shows the position of armature 7 when the polarizing flux is switched to gap A, thereby holding gap A closed with the attractive magnetic force. Even when the coil currents are zero, armature 7 always contacts either one flat surface of motor core 9 (distance A=0) or the other motor core 9'(distance B=0). This is because the armature 7 is mechanically bi-stable under the magnetic forces due to the polarizing ring magnet 28. The armature latches with either gap A or gap B at zero. The stroke of the moving assembly of armature 7, interface ring 6 and pump plunger 1 is fixed and equal to A+B.

Motor electrical terminals 31 and 31' provide connections for supplying current to coils 29 and 29'. The injector motor and pump 100 is conveniently contained in an overall shell 32 made of aluminum, for example. Shell 32 contains all the parts (except the spray valve 200) stacked up and retained by the retaining ring 33. The retaining ring will not, in general, create an endwise clamping force that would fix the pump parts within the shell 32. To do this, shell 32 is clamped up against the engine cylinder head by means of tie bolts (not shown) which provide an endwise force to clamp the spray valve 200 in place, and also clamp up the stacked parts within the shell 32.

Figure 7:
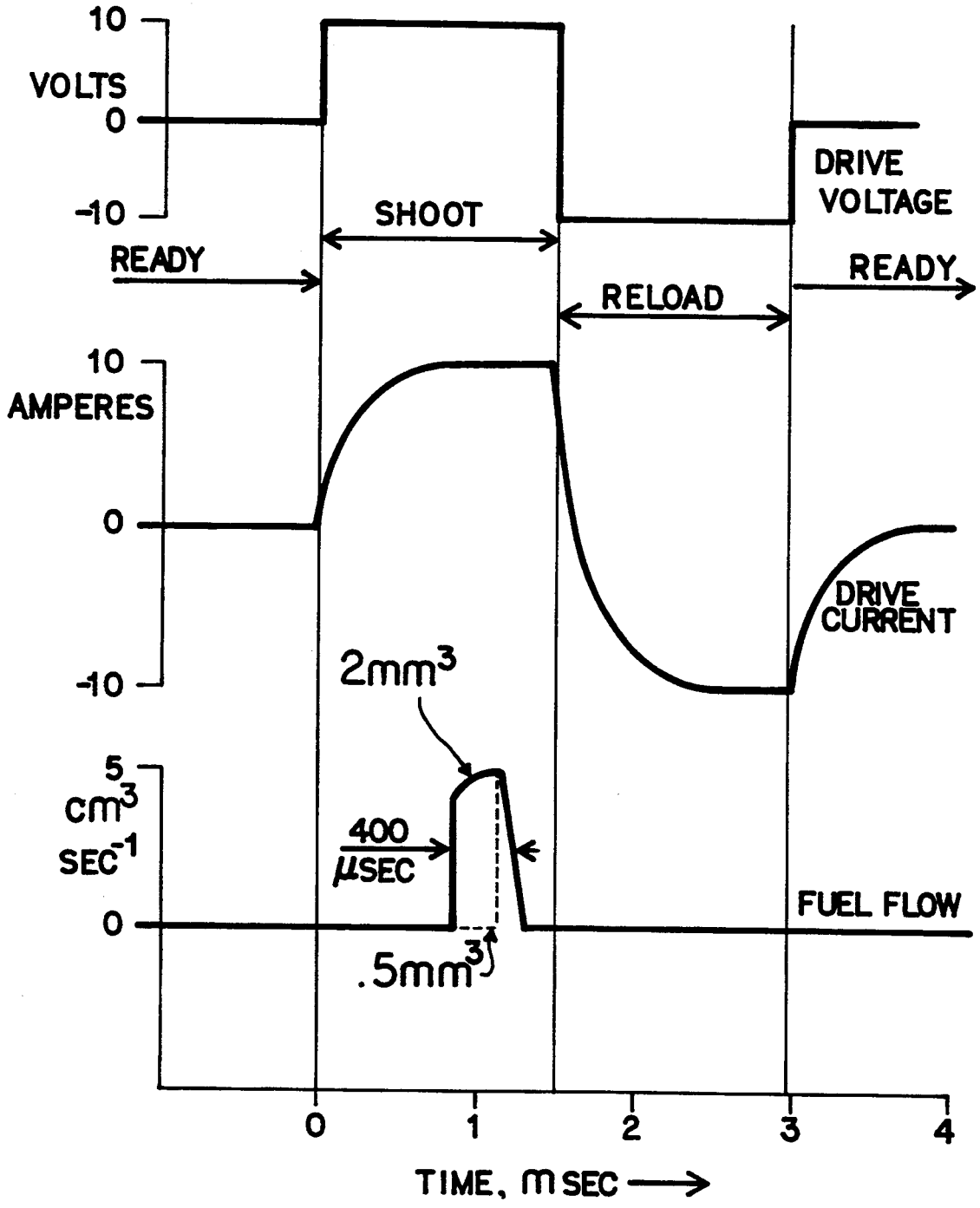
FIG. 7 is a collection of graphs depicting typical values of drive voltage, drive current and fuel flow versus time during a cycle of operation of the motor and pump according to the invention.

Fuel circulates through the fuel injector linear motor and pump by entering the central hose barb 34 of the pump delivery adjuster 5, flowing through the sting 4, and gushing out the end of the sting. This fuel flow cools the injector, provides fresh bubble-free and filtered fuel at the region near pump check slug 11, and exits the injector at an exit hose barb (not shown), flushing away heat and wear debris which could ruin the performance of the injector or spray assembly. The injector linear motor and pump typically performs in accord with the graphs of FIG. 7. When an electronic central unit attached to the engine calls for a shot of fuel, drive voltage switches on. The uppermost graph shows this occurring at time zero, 0.0 msec. The inductance, magnetic losses, and back emf limit the rate of rise of current to curves like those shown in the middle graph. At any given armature axial position the output force of the linear motor will be roughly proportional to the drive current. This current takes time to build. Therefore the armature cannot unlatch and begin to move until several tenths of a millisecond after drive voltage is imposed and the current has risen to about ½ of its final value, such as occurs at a time of 0.3 msec. Fuel cannot shoot until the armature has moved at least half-stroke. The lower graph shows the beginning of injection at a time of about 0.85 msec. Injection continues until the armature comes to rest at its end-stop, shown as occurring at a time of 1.25 msec. Note that the injection time—illustrated here for a maximum delivery volume of 2 $mm^3$—is 0.4 msec or 400 μsec. The average flow rate is equal to $0.002/0.0004=5\ cm^3\ sec^{-1}$. The average flow rate through the spray valve does not depend upon engine speed and it does not depend upon how much fuel is delivered according to the setting of the fuel volume adjuster. The general character of the spray is therefore maintained at all engine running conditions and speeds from idling to maximum power. If the delivery volume is reduced to 0.5 $mm^3$ or less by means of the fuel volume adjuster, then the injection time becomes as short as 70 μsec, as shown by the dotted curve.

While there is shown and described the present preferred embodiment of the invention, it is to be distinctly understood that this invention is not limited thereto but may be variously embodied to practice within the scope of the following claims.

I claim:

1. A fuel injector linear motor and pump comprising:

a motor core with a central bore volume, a central annular space and a central recessed volume;

a cylindrical pump barrel located within said central cylindrical space of said motor core;

an elongated pump plunger located within said pump barrel, said pump plunger having a backward stroke end and a forward stroke end;

a ferromagnetic armature of a certain width, said armature being annularly connected to the pump plunger, and being located in the said annular space in the said motor core, said annular space being greater in axial length than said armature;

a permanent polarizing magnet located within said central recessed area of said motor core, said magnet annularly surrounding said armature;

two motor drive coils, one on each radial side of said ring magnet, said motor drive coils being electrically connected to a source of switching current;

a pump bias spring connected to the backward stroke end of the pump plunger, said pump bias spring exerting a force upon the plunger in the direction of its forward stroke end;

a pump check slug located in said pump barrel near the forward stroke end of the pump plunger, said check slug having backward and forward stroke ends;

a check slug spring connected to the forward stroke end of said pump check slug, said check slug spring biasing the check slug toward the pump plunger's backward stroke end;

whereby liquid fuel ahead of the check slug that is sealed off by contact between the pump plunger and the check slug and existing within the voids of a spray valve is pressurized and thrust ahead to form a spray as a result of the forward stroke of the pump plunger which is in turn caused by switching of the standing polarizing magnetic flux in a linear electromagnetic motor.

2. The linear motor and pump of claim 1 which also comprises a tubular sting in the vicinity of the check slug, said sting being annularly surrounded by the elongated pump plunger.

3. The linear motor and pump of claim 2 wherein the axial location of the tubular sting is adjustable so that the volume of fuel delivered per stroke of the pump plunger is adjustable.

4. A fuel injector for internal combustion engines comprising:

a motor core with a central bore volume, a central annular space and a central recessed volume;

a cylindrical pump barrel located within said central cylindrical space of said motor core;

an elongated pump plunger located within said pump barrel, said pump plunger having a backward stroke end and a forward stroke end;

a ferromagnetic armature of a certain width, said armature being annularly connected to the pump plunger, and being located in the said annular space in the said motor core, said annular space being greater in axial length than said armature;

a permanent polarizing magnet located within said central recessed area of said motor core, said magnet annularly surrounding said armature;

two motor drive coils, one on each radial side of said ring magnet, said motor drive coils being electrically connected to a source of switching current;

a pump bias spring connected to the backward stroke end of the pump plunger, said pump bias spring exerting a force upon the plunger in the direction of its forward stroke end;

a pump check slug located in said pump barrel near the forward stroke end of the pump plunger, said check slug having backward and forward stroke ends;

a check slug spring connected to the forward stroke end of said pump check slug, said check slug spring biasing the check slug toward the pump plunger's backward stroke end;

a spray valve also connected to the forward stroke end of said pump check slug, said spray valve having pressure relief means and means to form a spray; and whereby liquid fuel ahead of the check slug that is sealed off by contact between the pump plunger and the check slug and existing within the voids of a spray valve is pressurized and thrust ahead to form a spray as a result of the forward stroke of the pump plunger which is in turn caused by switching of the standing polarizing magnetic flux in a linear electromagnetic motor, suitable for combustion in the headspace of an internal combustion engine.

5. The fuel injector of claim 4 which also comprises a tubular sting in the vicinity of the check slug, said sting being annularly surrounded by the elongated pump plunger.

6. The fuel injector of claim 5 wherein the axial location of the tubular sting is adjustable so that the volume of fuel delivered per stroke of the pump plunger is adjustable.

7. The fuel injector of claim 4 wherein the spray valve pressure relief means comprises a valve plate and an interface plate, with the valve plate accommodating a plurality of coned discs.

8. The fuel injector of claim 4 wherein the spray valve is comprised of plane-parallel plates with cut-outs such that a radial inflow of liquid fuel forms into a jet of cylindrical cross-section whose diameter is less than half of the diameter of any of the holes existing in the assembled stack of plane-parallel plates that comprise the spray valve.

9. An electromagnetic fuel injector which comprises:

a linear motor configured to have a motor core having a cylindrical pump barrel located within said motor core;

an elongated pump plunger slidably disposed within said pump barrel, said pump plunger having a backward stroke end and a forward stroke end, and operable for being driven a predetermined length in both said forward stroke and said backward stroke;

switching current means electrically connected to the linear motor for driving the pump plunger in forward stroke with a first predetermined force towards, and impacting into, a pump check slug, and backwards in said backward stroke;

said pump check slug slidably disposed within said pump barrel near the forward stroke end of the pump plunger, said check slug sealing the pump barrel from a nozzle assembly containing a volume of fuel;

said nozzle assembly for discharging a spray of fuel when subjected to hydraulic load imparted to the contained fuel when the plunger impacts the check slug with a second predetermined force;

a pump bias spring connected to the backward stroke end of the pump plunger, said pump bias spring exerting a force upon the plunger in the direction of its forward stroke end sufficient to increase the force at which the forward stroke end of the plunger impacts the check slug to match the second predetermined force required to discharge the spray of fuel from the nozzle assembly.

10. The electromagnetic fuel injector of claim 9 wherein the forward stroke end of the plunger does not impact upon the check slug until the plunger has been driven forward at least half of the length of its stroke travel.

11. The electromagnetic fuel injector of claim 9 which further comprises magnetic latching means for holding the plunger at the end of its backward stroke and in compression against the pump bias spring after termination of its back stroke and before initiation of being driven forward in said forward stroke.

* * * * *